US006003254A

United States Patent [19]

Lorber

[11] Patent Number: 6,003,254

[45] **Date of Patent: *Dec. 21, 1999**

[54] COMBINED GREETING CARD AND RECORD SLEEVE

[76] Inventor: Alan Lorber, c/o B. Wolpe, 414 E. 52 St., New York, N.Y. 10022

[ * ] Notice: This patent is subject to a terminal disclaimer.

[21] Appl. No.: 08/054,223

[22] Filed: Apr. 29, 1993

[51] Int. Cl.[6] ..... B26D 85/30

[52] U.S. Cl. ..... 40/124.06; 40/124.09; 206/312

[58] Field of Search ..... 40/124.1, 359, 40/159, 340, 124.06, 124.09; 229/68 R; 206/312, 311, 313

[56] References Cited

U.S. PATENT DOCUMENTS

| | | | |
|---|---|---|---|
| 1,243,037 | 10/1917 | Campbell | 206/312 |
| 3,426,960 | 2/1969 | Shore | 206/312 |
| 3,595,383 | 7/1971 | Boylon | 206/312 |
| 4,402,405 | 9/1983 | Fullalove | 206/312 |
| 4,433,780 | 2/1984 | Ellis | 40/124.1 |
| 4,473,153 | 9/1984 | Colangelo | 206/312 |
| 5,101,973 | 4/1992 | Martinez | 206/312 |

FOREIGN PATENT DOCUMENTS

| | | | |
|---|---|---|---|
| 783277 | 7/1935 | France | 206/312 |

*Primary Examiner*—Cassandra H. Davis

[57] ABSTRACT

A Combined greeting card and record sleeve in a side-fold design, incorporating in the front-sheet a phonographic record-sleeve as a pocket in which to receive an audio disc with a central die-cut to expose the label or logo of the disc received; and a back-sheet of relative size and dimension to the front-sheet on which is contained on the inside panel general greeting card indicia.

1 Claim, 1 Drawing Sheet

COMBINED GREETING CARD AND RECORD SLEEVE

BACKGROUND OF THE INVENTION

1. Field of the Invention

This invention relates to greeting cards, and more particularly, to a greeting card having a record sleeve to receive phonographic audio discs therein.

2. Description of the Prior Art

With the advent of worldwide manufacture and distribution of Compact Audio Discs (known as CDS) in the mid-80s, and the subsequent mass consumer acceptance of CDS by the early 1990s, major record companies rapidly replaced vinyl configurations of catalogues with CD reissues. However, in the process they eliminated the manufacture and distribution of 45s. And secondly, by the early 1990's, they totally ceased manufacture and distribution of vinyl 33⅓ LPS.

Since the bulk of a label's 45-singles were released over the past 50 years, such product was therefore also marked for extinction, unless initially released as part of a CD-artist compilation, or thereafter, subject to limited licensing to third- parties, i.e. for films or occasionally, for commercials. This resulted in a minimizing of vast back-catalogue sales potential. At the same time, the copyright-holders and music publishers of such songs that were contained on these previously released vinyl-catalogues suffered an equally negative result.

The present invention provides a means to recycle inactive record catalogues beyond the former conventions by reissuing them in a unique and novel reissue-device.

The greeting card having a record sleeve for receiving an audio disc permits a functionally new recycling purpose that distinguishes it from previously utilized ordinary standard record sleeves and greeting cards.

SUMMARY OF INVENTION

It is an object of this invention to provide a unique way to include a prerecorded audio disc in a greeting card.

It is the object of this invention to provide a greeting card when combined with a record sleeve can receive a prerecorded audio disc reflecting a portion of the greeting card indicia.

It is a further object of the invention to provide a die-cut portion of the greeting card to provide the purchaser with a way to view the label of the audio disc contained that will suggest an indication of such indicia without opening the package, and therefore, as a further objective, protecting the retailer against theft or destruction of merchandise.

Another object is to provide a device affording a novel and unique means of recycling record catalogues.

DESCRIPTION OF THE PREFERRED EMBODIMENT

Figure 1:
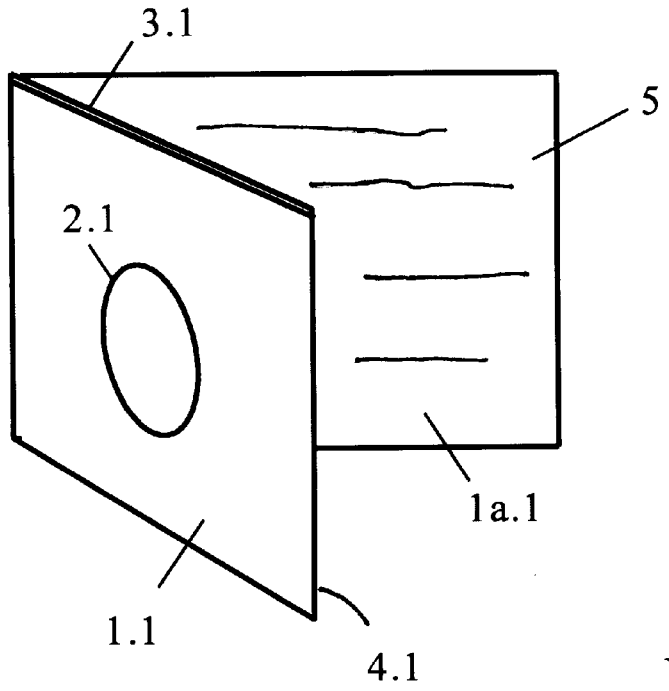
FIG. 1 is a perspective view of the fabricated greeting card and record sleeve defined by the present invention.
Figure 2:
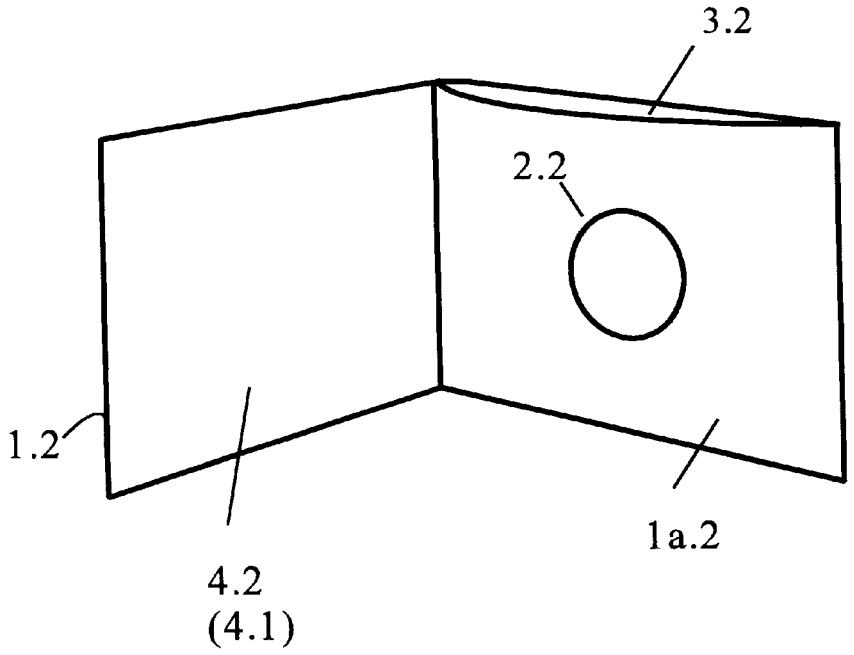
FIG. 2, we have a perspective view of an alternate embodiment of the greeting card and record sleeve defined by the present invention.

Referring now to FIG. 1 of the drawing, a combined greeting card and record sleeve is shown comprising a side-fold greeting card design which may be of thin material such as cardboard. The front sheet (1.1) and the rear-front sheet (4.1) unseen in FIG. 1 but depicted in FIG. 2 (as reference numeral 4.2) are connected together to form the pocket (3.1) as a record receiving sleeve. You can have in one embodiment a pocket in the front sheet and in the other (FIG. 2) a pocket in the back sheet. The front-sheet (1.1) of FIG. 1 has a die-cut (2.1) for viewing what is received in the record sleeve. The back sheet (1*a*.1) of FIG. 1 is of equal dimension to the front sheet, and contains on its inside panel customary general greeting card indicia(5). Referring now to FIG. 2., the front sheet (1.2) is unseen but depicted in FIG. 1 as (1.1). The rear front-sheet (4.1) that is unseen in FIG. 1, is indicated in FIG. 2 as (4.2). Similarly, in this FIG. 2 alternate embodiment of the greeting card and record sleeve, the back-sheet (1*a*.2) contains the receiving pocket (3.2) and the die-cut portion (2.2).

Although illustrative embodiments of the invention have been described herein with reference to the accompanying drawings, it is to be understood that the invention is not limited to those precise embodiments and that various other changes, modifications, juxtapositions and substitutions may be effected therein by one skilled in the art without departing from the scope and spirit of this invention.

In accordance with the teaching of my invention, I claim:

1. A side-fold greeting card design consisting of a front-sheet and a back-sheet of cardboard material, incorporating in the front-sheet a phonographic record-sleeve as a pocket which is adapted to receive an audio disc, employing a top opening which is adapted to be of sufficient length to correspond to the pre-determined dimension of the audio disc received, and a die-cut adapted to expose indicia on the disc received; with the back-sheet of relative size and dimension to the front-sheet on which is contained on an inside panel general greeting card indicia.

* * * * *